US005746295A

United States Patent [19]

Schweser, Jr.

[11] Patent Number: 5,746,295

[45] Date of Patent: May 5, 1998

[54] FLOOR-ROLLABLE LUGGAGE

[76] Inventor: Frederick G. Schweser, Jr., 330 E. Douglas (#209), Elkhorn, Nebr. 68022

[21] Appl. No.: 461,532

[22] Filed: Jun. 5, 1995

[51] Int. Cl.[6] ..... A45C 5/14; A45C 13/26

[52] U.S. Cl. ..... 190/18 A; 190/115; 280/37

[58] Field of Search ..... 190/18 A, 115, 190/39; 280/37, 655, 655.1, 47.315, DIG. 3; 16/115

[56] References Cited

U.S. PATENT DOCUMENTS

| | | | |
|---|---|---|---|
| 2,472,203 | 6/1949 | Friedmann et al. | 280/DIG. 3 X |
| 3,462,171 | 8/1969 | Mitty et al. | 280/37 X |
| 4,273,222 | 6/1981 | Cassimally et al. | 190/18 A |
| 4,354,583 | 10/1982 | Walker | 190/18 A |
| 4,383,141 | 5/1983 | Walker | 190/18 A |
| 4,411,344 | 10/1983 | Walker | 190/18 A |
| 4,442,927 | 4/1984 | Walker | 190/18 A |

FOREIGN PATENT DOCUMENTS

| | | | |
|---|---|---|---|
| 1099200 | 1/1968 | United Kingdom | 190/18 A |

*Primary Examiner*—Sue A. Weaver
*Attorney, Agent, or Firm*—George R. Nimmer

[57] ABSTRACT

Disclosed is Manually-drayable Floor-rollable Luggages including a preferably wholly-cellulosic upright and cargo-chargeable hollow container that is upwardly/downwardly slidably provided at vertical-bars with a manually-drayage which has underlying wheeled first-axle and co-horizontal wheeled second-axle that are together upwardly abuttable against the hollow container's lower extremity as the vertical-bars' manual-drayage is upwardly manually motivated by virtue of a manually-engageable pull-handle located above the hollow container.

2 Claims, 2 Drawing Sheets

FLOOR-ROLLABLE LUGGAGE

BACKGROUND OF THE INVENTION

The prior art teaches "floor-rollable luggage" generally comprising a-n upright hollow container underlyingly provided with constant-elevation floor-rollable wheels and further provided with upwardly slidably movable manual-drayage means unaffecting the constant-elevation underlying wheels. However, such prior art structures are constructionally complicated and too expensive for those who desire to become availed of readily attainable and economical "manually-drayable floor-rollable luggages", such as for economical availability at trade-shows offering trade-literature and/or trade-sample handouts, for shopping malls promotions of various giveaway promotional literatures/ materials, etc.

GENERAL OBJECTIVES OF THE PRESENT INVENTION

In view of the foregoing remarks, it is accordingly the general objective of the present invention to provide, as compared to prior art structures, improved "floor-rollable luggage" that are of constructionally simplified and of more utile and economical structures which are particularly advantageously economically and practically utilizeable for: luggage cargo-receptions at trade-shows and at shopping-malls collections of trade literatures and other materials receiveable at such locations; travel usages such as at airports and other terminals and/or travel conveyances, including within airports, trains, busses, airplanes, for ready movement and storages therewith, etc., and for many other ancillary usages which will become readily apparent to those who are interested in and familiar with luggages movement and storage problems.

GENERAL STATEMENT OF THE PRESENT INVENTION

The aforementioned general objectives of the present invention are accomplished with a "Floor-rollable Luggage" concept including a cargo-chargeable hollow container, preferably economically constructed throughout of cellulosic material, and including a generally horizontal base-panel portion and a loftily overlying upper portion (such as a horizontal upper-panel); and together with an upwardly/downwardly slidably associated man,ally-actuatable manual-drayage means including upright and parallel vertical-bars slidably associated with the hollow container 's base-panel and upper portions and including below the the hollow container's base-panel or other lowermost extremity, wheeled first-axle and wheeled second-axle that are upwardly abuttably against the hollow container's lowermost extremity as said manual-drayage means is motivated manually upwardly through a vertical-bars connective pull-handle overlying the hollow container's upper portion.

BRIEF DESCRIPTION OF THE DRAWINGS

In the drawings wherein like characters refer to like parts in the several views, and in which.

DETAILED DESCRIPTION OF THE DRAWING

Figure 1:
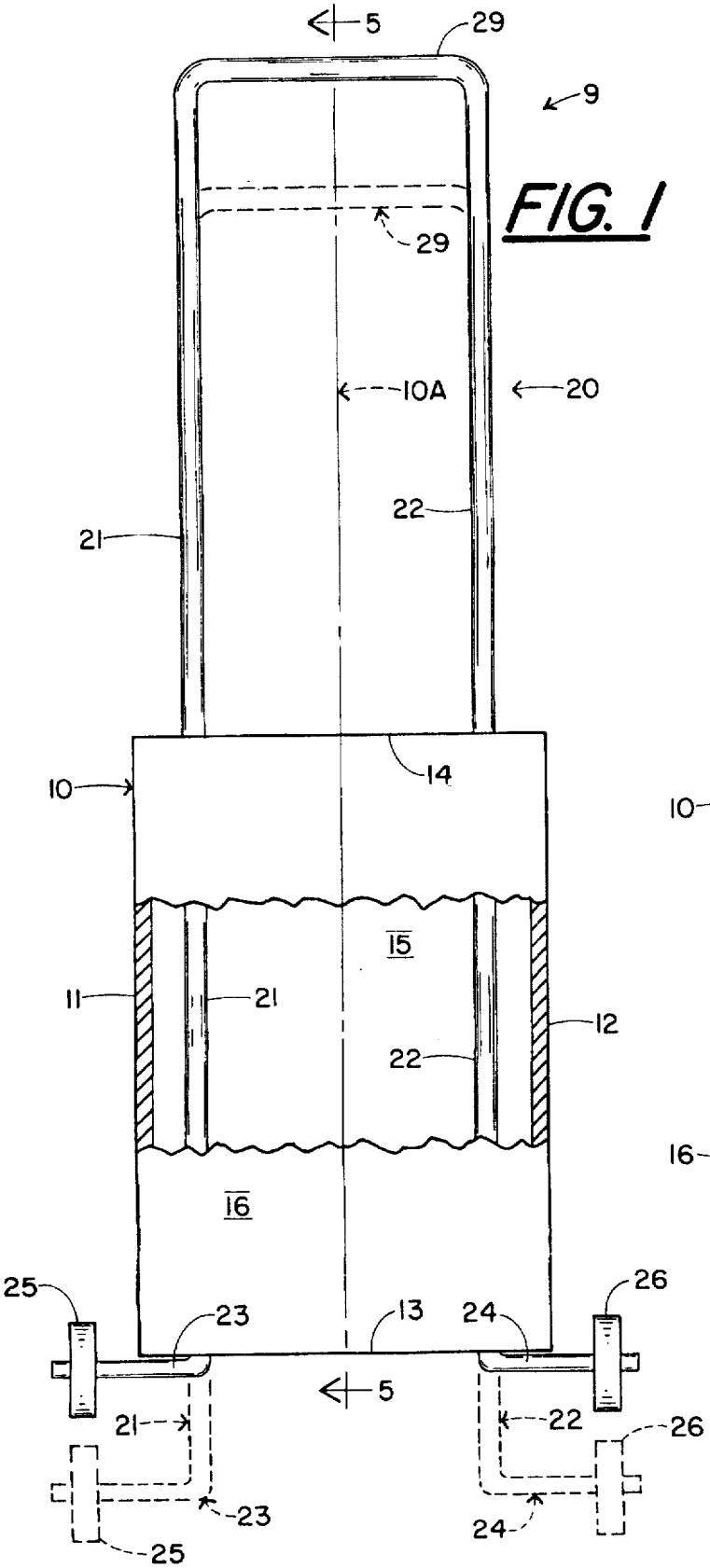
FIG. 1 is a frontal elevational view (partly in section) of and representative embodiment 9 of the "floor-rollable luggage" of the present invention.
Figure 2:
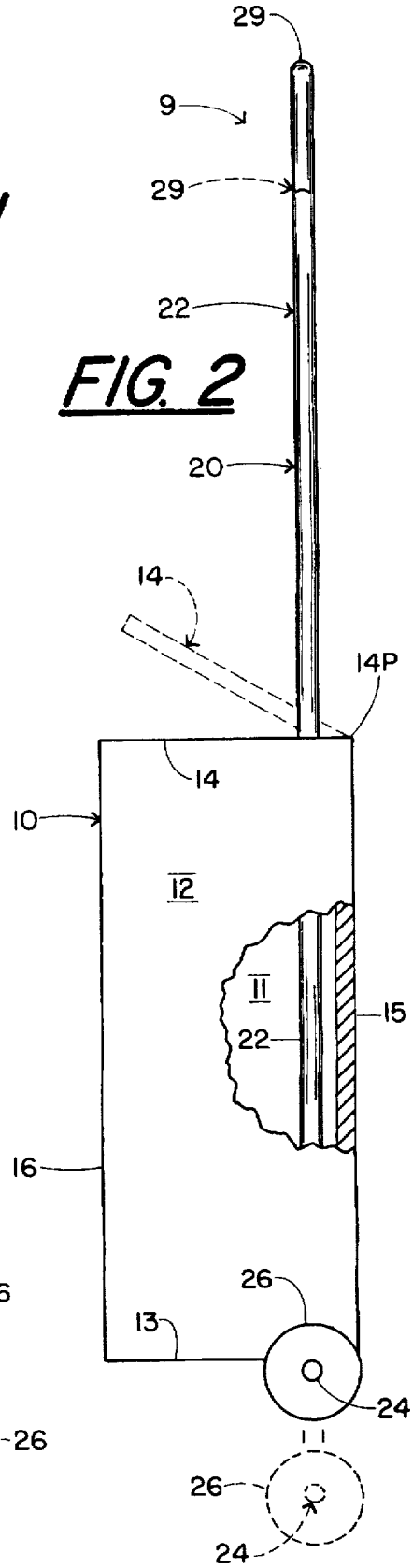
FIG. 2 is a sideward elevational view (partly in section) of representative embodiment 9.
Figure 4:
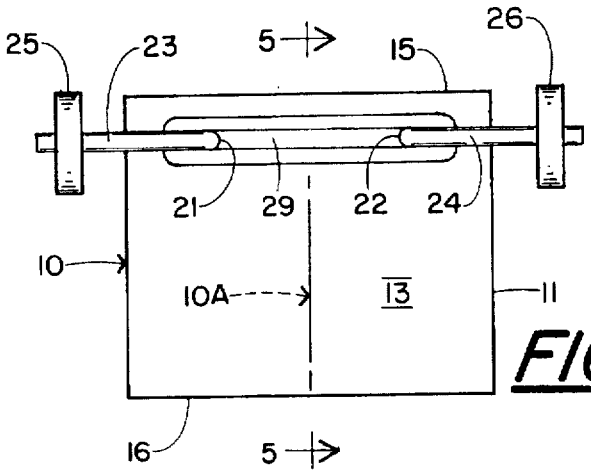
FIG. 4 is a bottom plan view of representative embodiment 9.
Figure 3:
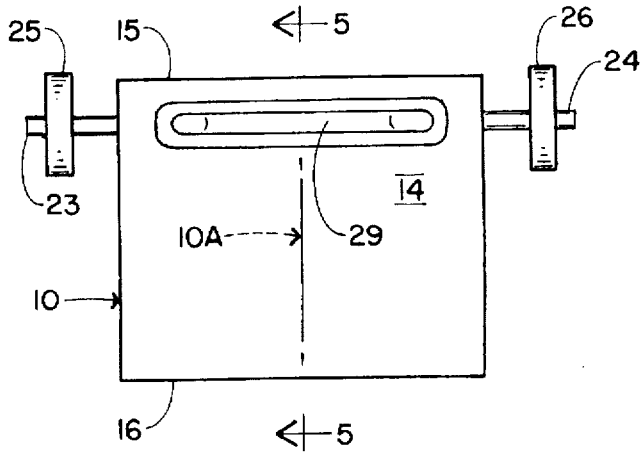
FIG. 3 is a top plan view of representative embodiment 9.
Figure 5:
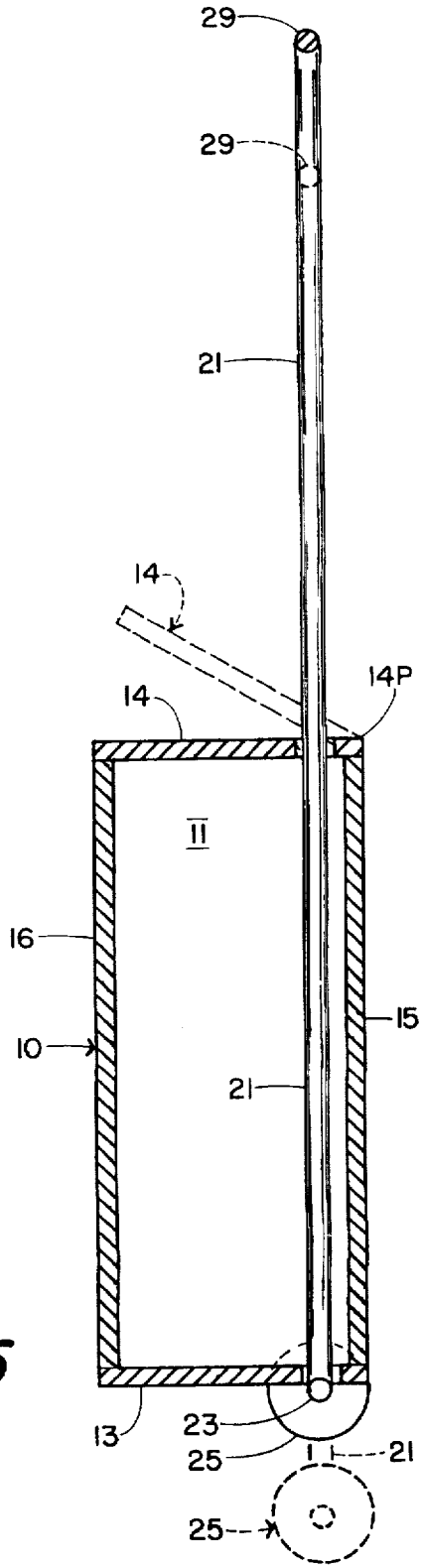
FIG. 5 is a sectional elevational view of representative embodiment 9 taken along lines 5—5 of FIGS. 1, 3, and 4;.

Drawing FIG. 1–5 depict representative embodiment 9 of the "floor-rollable luggage" of the present invention having two primary components, including: a cargo-chargeable (e.g. 14,14P) hollow container that slidably surrounds vertical-bars portions (e.g. 21, 22) of an upwardly slidably movably associated manual-drayage means (e.g. 20), namely, as follows:

A such hollow container 10, which is preferably substantially constructed throughout of cellulosic structural material, extends uprightly along and is substantially centrally intersected by an upright central-plane (10A) and with reference to such central-plane comprises six interconnected container portions, including:

(i) a pair of upright sidewalls directionally transversely flanking such central-plane (10A) including a first-side-wall (11) and a second-sidewall (12);

(ii) a generally horizontal and directionally transversely extending base-panel portion (13) which might provide the container's transversely extending lowermost extremity;

(iii) extending uprightly from the base-panel portion and respectively directionally intersecting central-plane 10A, an upright rearwall 15 and an upright frontwall 16; and (iv) a generally horizontal upper portion (e.g. 14) intersecting central-plane 10A and loftily overlying base-panel 13. Such upper portion might take the form of a horizontal upper-panel 14. Ancillary to the intended cargo-receiving means, a such upper-panel 14i might also be pivotably creasably topically associated (14P) to upright rearwall 15.

A such collectively upwardly/downwardly movable manual-drayage means with such hollow container (e.g. 20, with 10) basically comprises:

(Bi) a pair of upright and directionally transversely separated parallel vertical-bars respectively slidably surrounded by the hollow container (10) including a first-bar 21 located between central-plane 10A and said first-side-wall 11 and a second-bar 22 located between central-plane 10A and second-sidewall 12;

(Bii) extending directionally transversely intersecting central-plane 10A from a said first-bar 21 to a said second-bar 22 intersecting such central-plane 10A and loftily horizontally overlying said container's upper portion (e.g. 14), a vertical-bars' connective push/pull handle 29;

(Biii) extending directionally transversely from said first-bar 21 below the container's lowermost extremity (e.g. 13) and outwardly beyond the container's first-sidewall (11), a substantially horizontal first-axle 23 extending directionally outwardly beyond first-sidewall 11 and there being provided with outward first-wheel means (25);

(Biv) extending directionally transversely horizontally from said second-bar 22 below the container's lowermost extremity (e.g. 13) and in horizontal alignment wraith first-axle 23, and outwardly beyond the container's second-sidewall 12 and there being provided at second-axle 24 with outward second-wheel means (26); and whereby as such manual-drayage means (e.g. 20) is upwardly manually motivated, the said upwardly/ downwardly slidably surrounded first-axle (23) and second-axle (24) are upwardly stoppably abuttable against the transversely extending lowermost extremity of the hollow container (e.g. its base-panel 13, 113).

From the foregoing, the construction and operation of the "floor-rollable luggage" concept of the present invention will be readily understood and further explanation is believed to be unnecessary. However, since numerous modifications and equivalents will become readily apparent to those skilled in the art, it is not desired to limit the invention to the exact constructions shown and described, and accordingly, all further equivalents are desired to be claimed, according to the scope of the appended claims.

I claim:

1. Floor-rollable luggages comprising:

(A) an upright hollow container extending uprightly along and substantially centrally intersected by a vertical central-plane, and with reference to said central-plane comprising six interconnected portions including: a pair of upright and substantially parallel sidewalls transversely flanking said central-plane including a first-sidewall and a second-sidewall; a generally horizontal base-panel portion intersecting said central-plane; a generally horizontal upper portion spaced apart and overlying said base-panel portion and intersecting said central-plane; and a transversely intersecting front-wall; and said hollow container being provided with cargo-receiving means; and (B) an upwardly slidably movable underlying rolling means for said upright hollow container and comprising:

(Bi) a pair of upright and transversely separated parallel vertical-bars respectively slidably surrounded by said base-panel and upper portions and including a first-bar located between said central-plane and said first-sidewall and a second-bar located between said central-plane and said second-sidewall;

(Bii) extending transversely from said first-bar to said second-bar intersecting said central-plane and loftily overlying said container upper portion, a vertical-bars' connective pull-handle;

(Biii) extending transversely from said first-bar below the container base-panel portion and outwardly beyond said container first-sidewall, a substantially horizontal first-axle outwardly provided with first-wheel means; and (Biv) extending transversely from said second-bar below the container base-panel portion and outwardly beyond said container second-sidewall, a substantially horizontal second-axle outwardly provided with second-wheel means, and whereby as said underlying rolling means at the said pull-handle is upwardly moved and said first-bar and second-bar slide upwardly, said first-axle and second-axle will substantially simultaneously move upwardly and abut the base-panel lowermost portion of said container at the said base-panel thereof.

2. The floor-rollable luggage of claim 1 wherein the container's upper portion takes the form of a pivotably-associated upper-panel to also provide said car-o-receiving means; wherein the hollow container's base-panel portion and upper-panel portion are respectively directionally transversely slotted across said central-plane and to thereby slidably surround said transversely separated vertical-bar portions of said manual-drayage means.

* * * * *